US010315791B2

(12) United States Patent
Rea et al.

(10) Patent No.: US 10,315,791 B2
(45) **Date of Patent: *Jun. 11, 2019**

(54) METHOD AND MACHINE FOR MAKING SINGLE USE CAPSULES FOR BEVERAGES

(71) Applicant: GIMA, S.P.A., Zola Predosa (IT)

(72) Inventors: Dario Rea, Monterenzio (IT); Fabio Franceschi, Mordano (IT)

(73) Assignee: GIMA, S.P.A., Zola Predosa (IT)

( * ) Notice: Subject to any disclaimer, the term of this patent is extended or adjusted under 35 U.S.C. 154(b) by 612 days.

This patent is subject to a terminal disclaimer.

(21) Appl. No.: 14/405,718

(22) PCT Filed: Oct. 31, 2012

(86) PCT No.: PCT/EP2012/071550

§ 371 (c)(1),
(2) Date: Dec. 4, 2014

(87) PCT Pub. No.: WO2013/189555

PCT Pub. Date: Dec. 27, 2013

(65) Prior Publication Data

US 2015/0166204 A1 Jun. 18, 2015

(30) Foreign Application Priority Data

Jun. 20, 2012 (IT) ..... BO2012A0337

(51) Int. Cl.
*B65B 29/02* (2006.01)
*B65B 1/02* (2006.01)
(Continued)

(52) U.S. Cl.
CPC ..... *B65B 29/02* (2013.01); *B65B 1/02* (2013.01); *B65B 1/04* (2013.01); *B65B 7/164* (2013.01);
(Continued)

(58) Field of Classification Search
CPC ..... B65B 61/00; B65B 7/28; B65B 47/04; B65B 1/02; B65B 29/02; B65B 61/06;
(Continued)

(56) References Cited

U.S. PATENT DOCUMENTS 2,736,065 A * 2/1956 Wilcox ..... B29C 51/04 126/294
3,346,435 A * 10/1967 Beck ..... B29C 65/18 156/423
(Continued)

FOREIGN PATENT DOCUMENTS

EP 0 524 464 A1 1/1993
EP 1 167 204 A1 1/2002
(Continued)

*Primary Examiner* — Alexander M Valvis
*Assistant Examiner* — Thomas M Wittenschlaeger
(74) *Attorney, Agent, or Firm* — Pearne & Gordon LLP

(57) ABSTRACT

A method for making a single use capsule (1) for extraction or infusion beverages includes the step of: arranging a first strip (S1) of thermoformable filtering material above rigid bodies (2); joining the first strip (S1) of thermoformable filtering material to the rigid bodies (2) at respective rims (7); forming the first strip (S1) of thermoformable filtering material to achieve a filter (8) that defines a chamber (5); filling the chamber (5) with a dose (D) of product; closing the chamber (5) and the rigid body (2) with a closing lid (6). A machine for making single use capsules (1) for extraction beverages includes: a feeding system (40); a transport system (50); a joining station (60); a forming station (70); a filling station (80); and a closing station (90).

17 Claims, 3 Drawing Sheets

(51) Int. Cl.

| | |
|---|---|
| ***B65B 1/04*** | (2006.01) |
| ***B65B 47/04*** | (2006.01) |
| ***B65B 61/00*** | (2006.01) |
| ***B65B 7/28*** | (2006.01) |
| ***B65D 85/804*** | (2006.01) |
| ***B65B 61/06*** | (2006.01) |
| ***B65B 61/20*** | (2006.01) |
| ***B65B 7/16*** | (2006.01) |

(52) U.S. Cl.
CPC ..... *B65B 7/28* (2013.01); *B65B 29/022* (2017.08); *B65B 47/04* (2013.01); *B65B 61/005* (2013.01); *B65B 61/06* (2013.01); *B65B 61/20* (2013.01); *B65D 85/8043* (2013.01); *B65D 85/8046* (2013.01)

(58) Field of Classification Search
CPC ..... B65B 61/20; B65B 61/005; B65B 7/164; B65B 1/04; B65B 29/022; B65D 85/804; B65D 85/8043; B65D 85/8046; B29C 51/16; B29C 51/162; B29C 51/165; B29C 51/167; B31B 2120/406
USPC ..... 53/452, 453, 558, 559, 561, 471, 282, 53/478, 329.3
See application file for complete search history.

(56) References Cited

U.S. PATENT DOCUMENTS 3,509,686 A * 5/1970 Bergstrom ..... B65B 31/021 53/511
3,851,445 A * 12/1974 Schuh ..... B65B 7/164 53/282
4,024,694 A * 5/1977 Cooper ..... B65B 1/02 53/131.3
4,598,529 A * 7/1986 Pongrass ..... B65B 3/02 53/384.1
4,751,806 A * 6/1988 Gram ..... A23G 9/283 426/130
4,859,337 A * 8/1989 Woltermann ..... B65D 85/816 210/474
4,965,986 A * 10/1990 Klinkel ..... B65B 51/303 53/389.5
5,379,572 A * 1/1995 Giovannone ..... B29C 65/004 53/329.3
5,551,207 A * 9/1996 Beyer ..... A23L 3/375 141/129
5,564,252 A * 10/1996 Adelmann ..... B65B 1/02 53/202
5,577,370 A * 11/1996 Pajak ..... B65B 7/164 53/329.3
6,440,256 B1 8/2002 Gordon et al.
6,662,531 B1 * 12/2003 Schwab ..... B29C 51/02 53/282
7,296,779 B2 * 11/2007 Bakshi ..... A47B 91/026 248/354.1
7,910,145 B2 * 3/2011 Reati ..... B26F 1/40 426/425
8,276,639 B2 * 10/2012 Binacchi ..... B65B 29/02 156/443
8,875,478 B2 * 11/2014 Fitzgerald, IV ..... B65B 9/08 53/450
9,221,227 B2 * 12/2015 Boldrini ..... B65B 29/00
9,428,329 B2 * 8/2016 Trombetta ..... B65D 85/8043
2001/0008064 A1 * 7/2001 Todd ..... B29C 66/431 53/455
2003/0079440 A1 * 5/2003 Luc ..... B65B 7/01 53/282
2005/0224373 A1 * 10/2005 Bailey ..... B65B 9/093 206/219
2007/0204567 A1 * 9/2007 Wintring ..... B65B 5/024 53/452
2008/0299262 A1 * 12/2008 Reati ..... B26F 1/40 426/84
2009/0211713 A1 8/2009 Binacchi
2010/0256797 A1 * 10/2010 Conti ..... B65B 9/042 700/122
2011/0259205 A1 * 10/2011 Delorme ..... B65D 65/466 99/299
2012/0247072 A1 * 10/2012 Romijn ..... B65B 9/213 53/558
2012/0269933 A1 10/2012 Rapparini
2012/0301581 A1 * 11/2012 Abegglen ..... B65D 85/8043 426/112
2013/0209618 A1 * 8/2013 Trombetta ..... A47J 31/06 426/115
2014/0109529 A1 * 4/2014 Hayakawa ..... B67C 3/242 53/558
2014/0202120 A1 * 7/2014 Scrivani ..... B65B 43/52 53/558
2014/0230370 A1 * 8/2014 Bianchi ..... B65B 29/02 53/410
2015/0056340 A1 * 2/2015 Trombetta ..... B65D 85/8043 426/115
2015/0056341 A1 * 2/2015 Trombetta ..... B65D 85/8043 426/115
2015/0291347 A1 * 10/2015 Rivola ..... B65B 29/02 426/77
2015/0352044 A1 * 12/2015 Benson ..... A61J 1/1443 206/205
2016/0229570 A1 * 8/2016 Rea ..... B65B 29/02
2016/0270591 A1 * 9/2016 Fujita ..... B65D 81/3407
2017/0086617 A1 * 3/2017 Hibi ..... A23L 7/109

FOREIGN PATENT DOCUMENTS

EP 2 093 148 A1 8/2009
WO 2011/047836 A1 4/2011

* cited by examiner

METHOD AND MACHINE FOR MAKING SINGLE USE CAPSULES FOR BEVERAGES

FIELD OF THE INVENTION

The present invention relates to a method and a machine for making single use capsules for beverages.

BACKGROUND OF THE INVENTION

There are known in the art single use capsules for extraction beverages of the type comprising, typically:

- a rigid body, cup—shaped, (usually, but not limiting, with a troncoconical shape) with a pierceable (or pre-pierced) bottom and an upper aperture provided with a rim;
- a filtering element to define a containing chamber;
- a dose of extraction product (for example in powder or granules) contained in the chamber and adapted to be contacted by a liquid under pressure;
- a closing lid for closing the upper aperture of the rigid body and the chamber, adapted (usually, but not limiting) to be pierced by a nozzle for filling liquid under pressure.

The illustrated capsule is used in machines for making beverages comprising a housing for the capsules.

The closing lid of the capsule is usually pierced by a nozzle for filling liquid under pressure (hot water) that distributes on the product contained in the chamber in order to obtain the beverage.

The bottom of the rigid body is pierceable by means of different types of organs, like sharpened and hollow elements, adapted to penetrate the bottom and to guide the so obtained beverage towards a delivery nozzle.

A method and machine for making capsules of the type illustrated is known from EP-A-2093148.

The method (and machine) illustrated in EP-A-2093148 provides for cutting a portion of filtering material, suitably shaping the portion, and joining the shaped portion to an internal wall of the rigid body by means of radial sealers in two successive sealing stations.

The method (and machine) illustrated in EP-A-2093148 is quite complicated, because of the shaping and joining steps. In particular, it is quite complicated to join the portion, already shaped, of filtering material to the internal wall of the rigid body.

SUMMARY OF THE INVENTION

It is an object of the present invention to provide a method for making single use capsules for beverages that is simple, quick and precise.

It is a further object of the present invention to provide a machine for making single use capsules for beverages, carrying out the method of the invention, that is simplified and with high productivity.

The above objects are achieved by a method according to claim 1 and by a machine according to claim 10.

In particular, a method according to the invention provides for a step of positioning a first strip of filtering material above rigid bodies, fed singly or in form of a second strip of thermoformed alveolate material; a step of joining the first strip of filtering material to rims of the rigid bodies; and a step of forming the first strip of filtering material to form a filtering element that defines a chamber for respective doses of product within respective rigid bodies.

Furthermore, a method according to the invention provides for filling the chambers with a respective dose of product and a step of closing the chambers with a respective closing lid.

Subsequently the step of joining, one or more steps of cutting are provided for cutting at least the filtering element, advantageously the filtering element and the closing lid.

Thus, the method according to the invention provides for joining the filtering material to the rigid body and, only subsequently, forming the filtering material to define the chamber.

The problem of accurate positioning the filtering element with respect to the rigid body of the known methods, that provide for thermoforming the filtering material before joining the filtering element to the rigid body, is thus overcome by the method of the invention.

The method according to the invention simplifies the step of positioning and joining the filtering element to the rigid body, as it provides for operating on plane surfaces both of the filtering element (fed through the first strip) and of the rigid body, in particular of the rim.

Moreover, the method according to the invention provides for cutting the filtering material only after the first strip is joined to the rim of the rigid body, so achieving an easier cutting of the filtering material, as the rim of the rigid body acts as an abutment element.

BRIEF DESCRIPTION OF THE FIGURES

These and other advantages of the invention will be clearly illustrated in the following detailed description and drawings of preferred embodiments, given by way of non limiting examples, wherein.

DETAILED DESCRIPTION OF THE INVENTION

Figure 1:
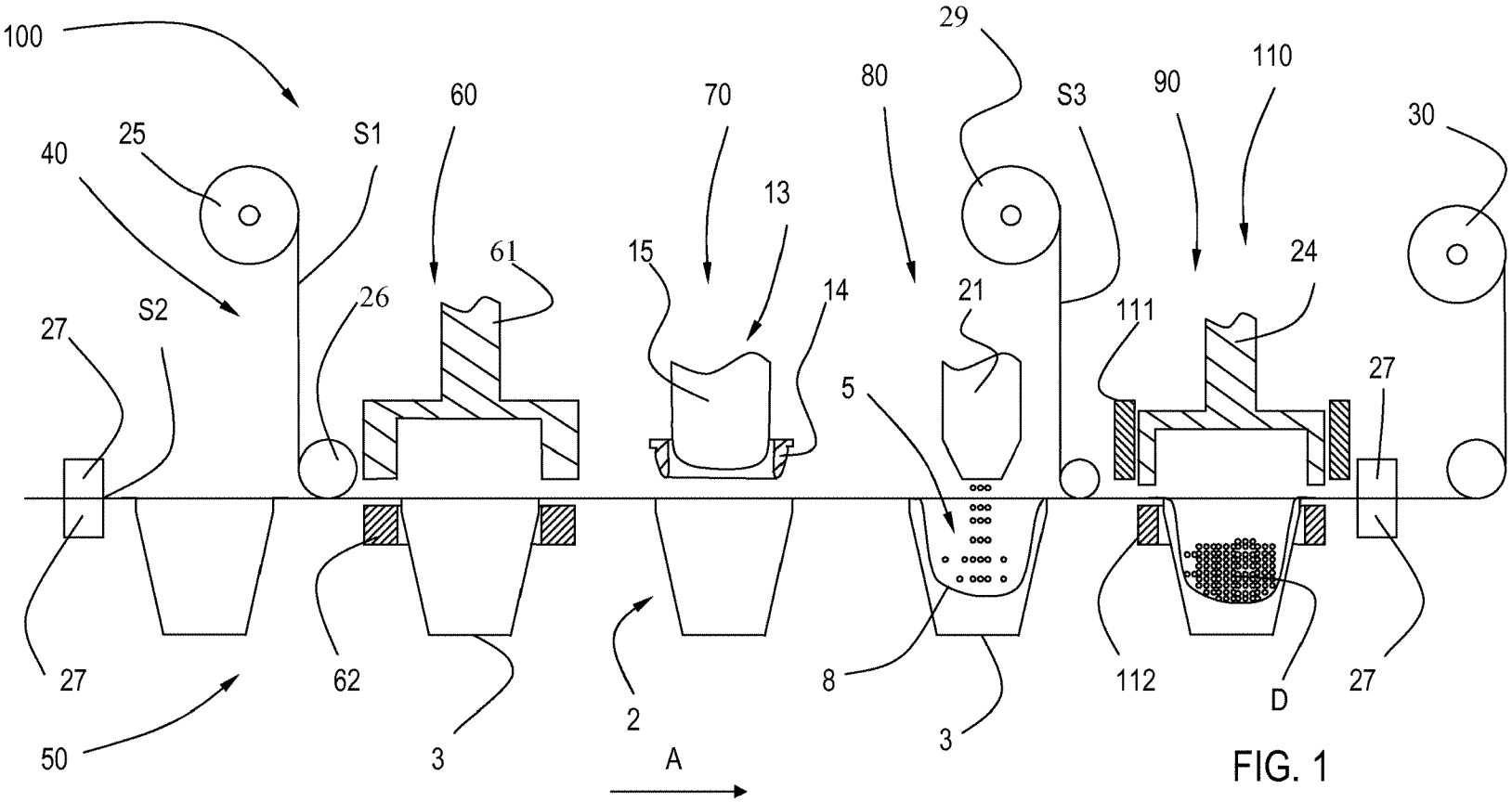
FIG. 1 is a schematic front view of a machine carrying out a method for making single use capsules for beverages of the extraction type according to the present invention.

According to the figures, in particular FIG. 1, a method according to the invention is carried out for making single use capsules 1 for beverages of the extraction or infusion type.

Figure 3:
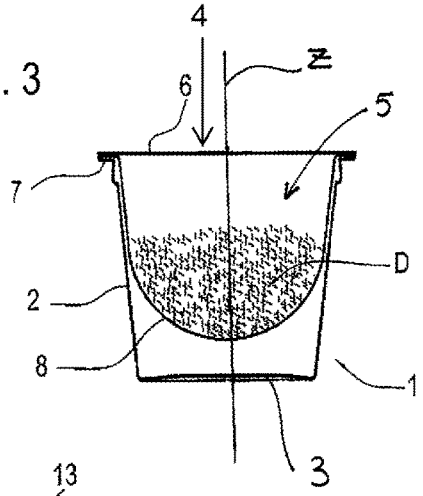
FIG. 3 is a front view, with some parts cut away for sake of clearness, of a single use capsule for beverages made by the method and machine of the invention.

In particular (see FIG. 3), the capsule 1 includes a rigid body 2, that extends along a main direction Z, cup shaped and featuring a bottom 3 and an upper aperture, or mouth, 4. The bottom 3 can be closed and pierceable, or pre-pierced.

The rigid body 2, preferably, features a troncoconical section with the bottom 3 having smaller dimension that the upper aperture 4.

The upper aperture 4 is delimited by a rim, or collar, 7, that features an upper surface perpendicular to the main direction Z. Preferably, the rim 7 is circular and extends radially.

The upper aperture 4 of the rigid body 2 is engaged by a filtering element, or filter, 8 which is configured so as to extend, with a concave section, within the rigid body 2 to define a chamber 5 adapted to contain a dose D of product, for example in powder or granules. In particular, the filtering element 8 is coupled to the rim 7 of the upper aperture 4 of the rigid body 2. The filtering element 8 is made of formable material, advantageously thermoformable material.

The capsule 1 further includes a closing lid 6 that closes the upper aperture 4 along the rim 7. The closing lid 6 can be associated to the rim 7 only, or to the rim 7 and the filtering element 8, or the filtering element 8 only.

The closing lid 6 can be rigid or flexible, air-tight or pre-pierced, depending on the machine for making beverages in which the capsule 1 is used.

The filtering element 8 allows to retain the dose D of product and to filter the beverage obtained towards the bottom 3 of the rigid body 2.

The bottom 3, if closed, is in turn pierced by means of organs adapted to direct the so obtained beverage to delivery nozzles.

According to the invention, the method for making capsules 1 includes, in sequence, the steps of (see FIGS. 1 and 2):

- feeding a plurality of rigid bodies 2;
- positioning a first strip S1 of thermoformable filtering material above the rigid bodies 2;
- firmly joining the first strip S1 of thermoformable filtering material to the rigid bodies 2 at a joining zone along respective rims 7;
- forming the filtering element 8 that defines the chamber 5 adapted to contain the dose D of product;
- filling the chamber 5 with a dose D of product;
- closing the chamber 5 and the upper aperture 4 of the rigid body 2 with a respective closing lid 6.

In the step of feeding, it is possible to feed the rigid bodies 2 singly, for example by means of movable drawers 9 onto which suitable seats are achieved for the rigid bodies 2.

Alternatively, in the step of feeding, it is possible to feed the rigid bodies 2 in form of a second strip S2 of thermoformed material comprising an orderly plurality of rigid bodies 2. The second strip S2 may be continuous or discontinuous to form an alveolate band, or a plurality of alveolate trays, respectively. For example, the second strip S2 can be moved by means of pull clamps 27 (schematically illustrated in FIG. 1), or by means of the movable drawers 9, or by means of suitable drawing rollers.

The method according to the invention further includes a step of cutting, to achieve single finished, capsules 1.

According to a first alternative embodiment, a single step of cutting can be provided for downstream of the step of closing to cut the closing lid 6, the first strip S1 of filtering material and the rigid body 2 (in case the latter is fed in form of second strip S2).

According to a different alternative embodiment, two or more steps of cutting can be provided.

For example, if the rigid bodies 2 are singly fed, a first step of cutting can be provided for immediately downstream of any one of the steps of joining, forming and filling to cut the first strip S1 of filtering material, and a second step of cutting can be provided for downstream of the step of closing to cut the closing lid 6.

According to a further embodiment, if the rigid bodies 2 are fed in form of second strip S2 of thermoformed alveolate material, a first step of cutting can be provided for immediately downstream of any one of the steps of joining, forming and filling to cut the first strip S1 and the second strip S2 to form single rigid bodies 2, and a second step of cutting can be provided for downstream of the step of closing to cut the closing lid 6.

With such a succession of steps, it is possible to position and join (by means of sealing or hot or cold gluing, or by means of ultrasounds) the filter 8 to the rim 7 of the upper aperture 4 in an extremely simple and precise way, as in the step of positioning and in the step of joining the first strip S1 and the rim 7 contact at respective plane and mutually parallel surfaces.

Furthermore, as the step of cutting is achieved downstream of the step of joining, it is possible to cut the first strip S1 of filtering material in an extremely simple and effective way, even if material that are usually difficult to cut are employed, thanks to the rim 7 of the rigid body 2 that acts as abutment.

Only limited portions of the first strip S1 of thermo formable filtering material are involved in the step of forming, in particular the portions of the first strip S1 arranged at the upper apertures 4 of the rigid bodies 2 only.

Advantageously, the step of forming includes:

- a first sub-step of forming, or step of pre-forming, for partially forming the filtering element 8 towards the interior of the rigid body 2, and
- a second sub-step of forming, or step of final forming, for completely forming the filtering element 8, so defining the chamber 5.

Figure 4:
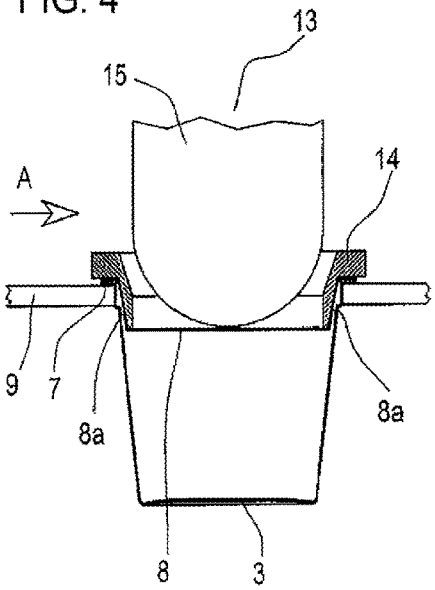
FIGS. 4 and 5 illustrate a step of forming a filtering element of a capsule in the machine of FIG. 2, in a schematic front view, with some parts cut away for sake of clearness.

Advantageously, in the step of pre-forming (see FIGS. 4 and 6) an annular zone 8*a* of the filtering element 8, adjacent and internal to the joining zone, is affected by a plastic deformation.

Figure 5:
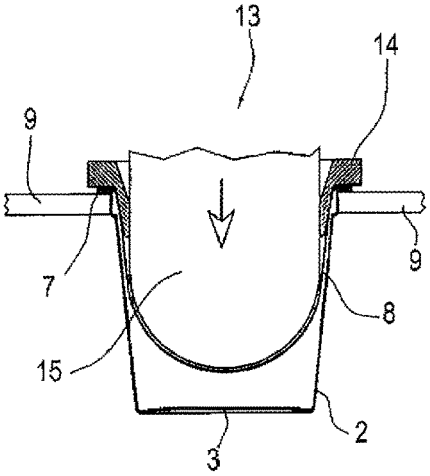
Figure 7:
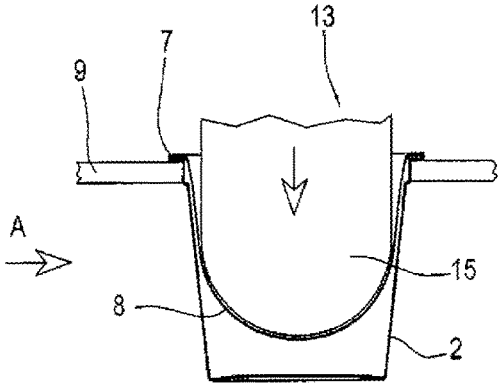

In the step of final forming, a central zone of the filtering element 8, internal to the annular zone 8*a*, is affected by a plastic deformation (see FIGS. 5 and 7).

The step of forming in two subsequent sub-steps allows to modulate the plastic deformation of the filtering material, so avoiding risks of fractures and cracks.

Preferably, the step of forming the filtering element 8 is achieved by means of heat transfer.

It has to be noted that both the first sub-step and the second sub-step of forming are preferably achieved by means of heat transfer.

Advantageously, in the step of joining, the first strip S1 of filtering material is joined to the rim 7 of the rigid body 2 by means of welding, i.e. through heat transfer, by means of hot or cold gluing, or by means of ultrasounds.

The present invention further provides a machine 100 for making the single use capsules 1 for extraction or infusion beverages.

The machine 100 includes a feeding system 40 for feeding a first strip S1 of thermoformable filtering material; a transport system 50 for transporting the rigid bodies 2 along an advancing direction A, either singly or in form of a second strip S2 of thermoformable material on to which an orderly plurality of rigid bodies 2 has been achieved; and a joining station 60 adapted to join the first strip S1 to the rigid bodies 2 at a joining zone along respective rims 7.

The second strip S2 may be continuous or discontinuous, to form an alveolate band or a plurality of alveolate trays, respectively.

Downstream of the joining station 60, the machine 100 includes a forming station 70 adapted to form the first strip S1 of filtering material to achieve a filtering element, or filter, 8 that defines a chamber 5 adapted to contain a dose D of product.

Downstream of the forming station 70, the machine 100 includes, in sequence, a filling station 80 adapted to fill the chamber 5 with a dose D of product and a closing station 90 adapted to close the chamber 5 with a closing lid 6.

Advantageously, the machine 100 includes at least one cutting station 110, integral with, or arranged downstream of, the closing station 90 adapted to cut the closing lid 6, the first strip S1 of filtering material and the second strip S2 of thermoformable material to achieve single finished capsules 1. In case the rigid bodies 2 are singly fed to the machine 100, the cutting station 110 is adapted to cut the first strip S1 of filtering material and the closing lid 6.

In an alternative embodiment, the machine 100 may include a first cutting station arranged immediately downstream of any one of the joining station 60, forming station 70 and filling station 80 and adapted to cut the first strip S1 of filtering material and the second strip S2 of thermoformable material (in case the rigid bodies 2 are fed in form of the second strip S2), and a second cutting station integral with, or arranged downstream of, the closing station 90, adapted to cut the closing lid 6.

The feeding system 40 may comprise a feeding roll 25 for feeding the first strip S1 of filtering material and a idle roller 26 adapted to make the first strip S1 sliding upon the rigid bodies 2 along the advancing direction A.

The transport system 50 may comprise movable drawers 9 adapted to house in suitable seats, and to move, the rigid bodies 2; or, in the embodiment in which the rigid bodies 2 are fed in form of the second strip S2, one or more pull clamps 27 (schematically illustrated in FIG. 1). In alternative embodiments not illustrated, the transport system 50 may comprise pulling rollers suitably shaped, at least one of which driven, to move the second strip S2 along the advancing direction A.

The joining station 60 may comprise one or more joining sealers 61 shaped to join the first strip S1 to the rim 7 of the rigid bodies 2 at an upper surface of the rim 7 that defines the joining zone. The joining sealers 61 can be reciprocatingly movable along a direction perpendicular to the advancing direction A of the first strip S1 and the rigid bodies 2. The joining station 60 may further comprise, below the rigid bodies 2, an abutment element 62 for cooperating with the joining sealers 61. Advantageously, in the embodiment illustrated in FIG. 2, the movable drawers 9 further acts as abutment element.

In an alternative embodiment, the joining station 60 may comprise a joining sealing roller, movable in rotation about an axis perpendicular to the advancing direction A. In such alternative embodiment, the same movable drawers 9 can act as abutment element, or the abutment element may assume the shape of a counter-roller, movable in rotation about an axis perpendicular to the advancing direction and parallel to the axis of rotation of the joining sealing roller.

The joining station 60, in particular the joining sealers 61 and the joining sealing rollers, may operate in hot or cold conditions, or by means of ultrasounds.

The forming station 70 includes forming means 13 adapted to plastically deform the filtering material.

The forming means 13 includes a forming punch adapted to plastically deform the filtering element 8 to define the chamber 5.

Advantageously, the forming means 13 includes a first, or pre-forming, punch 14 adapted to thermoform an annular zone 8*a* of the filtering element 8 adjacent and internal to the joining zone (FIGS. 4 and 6), and a second, or final forming, punch 15 adapted to thermoform a central zone of the filtering element 8 internal to the annular zone 8*a* (FIGS. 5 and 7).

The first punch 14 includes a heated ring element with a respective external contact surface, inclined and configured for thermoforming the annular zone 8*a* of the filtering element 8. The first punch 14 is movable in a direction perpendicular to the advancing direction A, between an operative position wherein it contacts and thermoforms the first strip S1 penetrating within the rigid body 2 and an inoperative position far away from the first strip S1 and the rigid body 2. In substance, the first punch 14 allows to obtain a sort of "flaring" of the filtering element 8 so as to prepare the filtering material in the annular zone 8*a* to the subsequent complete thermoforming, so avoiding tears and cracks.

The second punch 15 includes a forming head featuring a respective contact surface, for example hemispherical, adapted to contact and thermoform the central zone of the filtering element 8, so as to define the chamber 5. The second punch 15 is movable parallelly to the first punch 14 in direction perpendicular to the advancing direction A, between an operative position wherein it contacts and thermoforms the first strip S1 penetrating within the rigid body 2 and an inoperative position far away from the first strip S1 and the rigid body 2. In substance, the second punch 15 completes the thermoforming of the filtering element 8.

In the embodiment illustrated in FIGS. 1, 2, 4 and 5, the first punch 14 and the second punch 15 are coaxial and operatively coupled to pre-form and subsequently completely form the filtering element 8. In detail, the second punch 15 is dimensioned to slide within the first punch 14, after the latter has pre-formed the filtering element 8.

Figure 6:
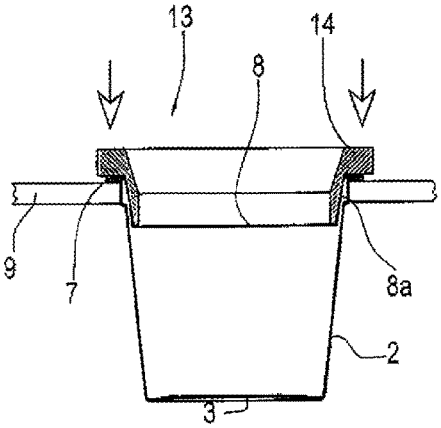
FIGS. 6 and 7 illustrate a different embodiment of the step of forming the filtering element of FIGS. 4 and 5, in a schematic front view.

In FIGS. 6 and 7, there is illustrated an alternative embodiment, in which the second punch 15 is arranged downstream of the first punch 14 along the advancing direction A.

In the embodiments illustrated in the figures, the second punch 15 does not contact the annular zone 8*a*. In an alternative embodiment not illustrated, in case the first punch 14 and the second punch 15 are not coaxial, the second punch 15 may have dimensions adapted to contact both the central zone and the annular zone 8*a* of the filtering element 8.

In embodiments not illustrated, the forming station 70 may comprise forming means with a single forming punch, adapted to thermoform the filtering element 8 in a single step.

The filling station 80, arranged downstream of the forming station 70 along the advancing direction A, includes at least one dosing organ 21 positioned above the rigid body 2 and adapted to feed a dose D of product (for example in powder or granules) to the chamber 5.

The closing station 90, arranged downstream of the filling station 80 along the advancing direction A, includes coupling means 24 for coupling the closing lid 6 to the rigid body 2 at the rim 7. In the illustrated embodiment, the closing lid 6 is fed in form of a third strip S3 above the rigid bodies 2. The coupling means 24 may comprise at least a sealing organ, reciprocatingly movable along a direction perpendicular to the advancing direction A and shaped for acting on the third strip S3 in correspondence of the rim 7 of the rigid body 2. The sealing organ may operate, for example, in hot or cold conditions, or by means of ultrasounds, to couple the closing lid 6 to the rim 7 only, or to the rim 7 and the filtering element 8, or to the filtering element 8 only. Advantageously, the closing lid 6 is sealed to the filtering element 8 in correspondence of the rim 7 of the rigid body 2. In an alternative embodiment not illustrated, the sealing organ may be shaped as a sealing roller, movable in rotation about an axis perpendicular to the advancing direction A.

A cutting station 110 may be integrated in to the closing station 90 and may comprise a cutting organ 111, that operates in phase with the coupling means 24, featuring a respective abutment element 112 (see FIG. 1).

Figure 2:
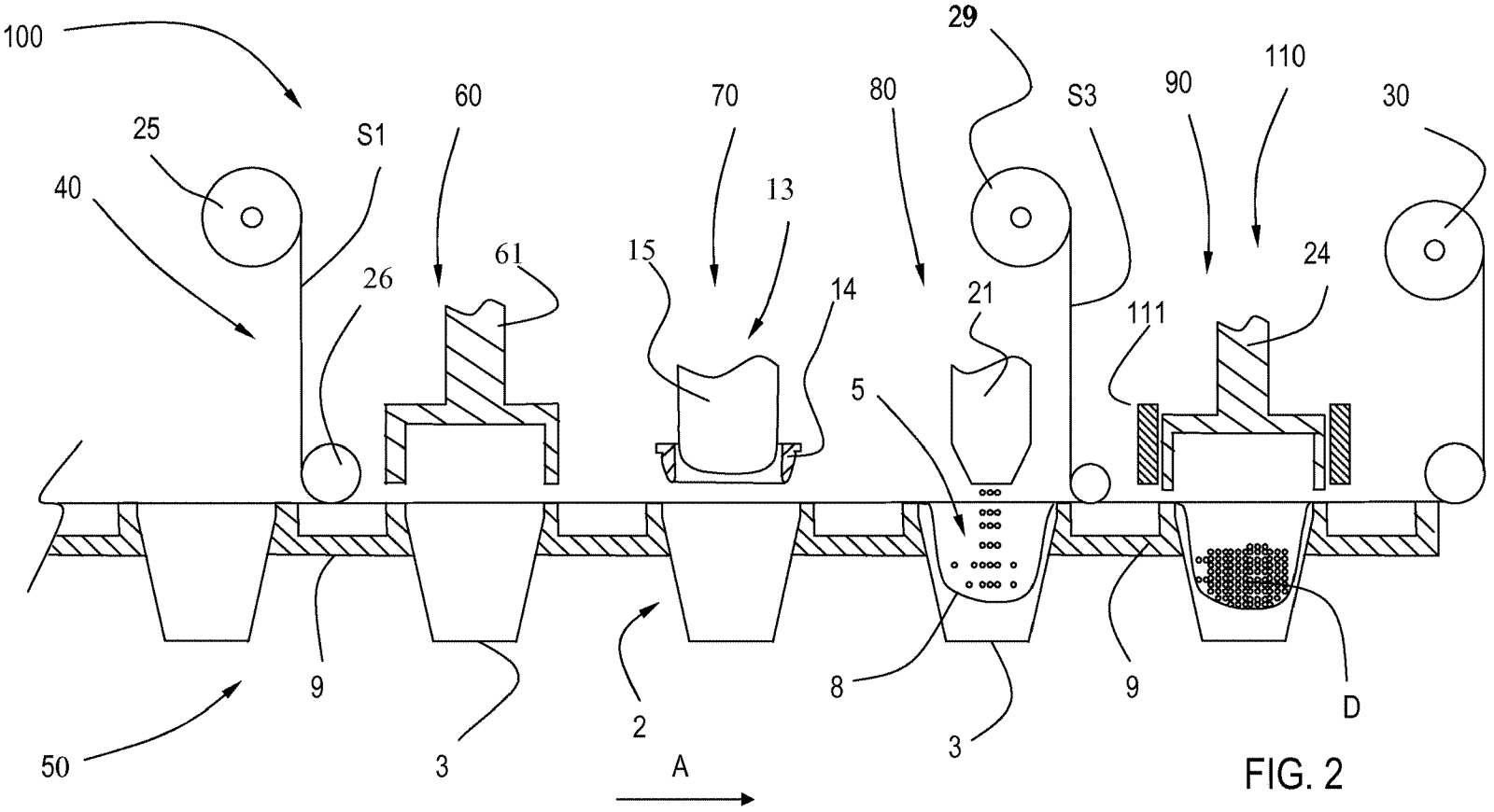
FIG. 2 is a different embodiment of the machine of FIG. 1.

In the embodiment of FIG. 2, the movable drawers 9 can act as abutment element for the cutting organ 111.

Alternatively, the cutting station 110 may be arranged downstream of the closing station 90 along the advancing direction A.

The third strip S3 is fed by means of a roll 29, while the scrap generated by the cutting station 110 is recovered by means of a further roll 30.

The method and machine so conceived completely achieve the advantages set forth above.

The steps of joining and thermoforming the filtering element starting from a plane portion of filtering material allow to obtain a high quality capsule. In fact, by operating on plane surfaces, it is possible to position the chamber relative to the rigid body in a very precise way and to obtain a better perimetral joining between the filtering element and the rim.

The invention claimed is:

1. Method for making single-use capsules for extraction or infusion beverages including a rigid body, cup-shaped and featuring a bottom and an upper aperture with a rim, a filtering element engaging the upper aperture and configured to present a concavity within the rigid body so as to define a chamber adapted to contain a dose of product, and a closure lid adapted to close the chamber and the upper aperture, the rigid body being impermeable to beverage, the filtering element being effective as a filter for beverage, characterised by including the following steps, in sequence:

feeding a plurality of rigid bodies;

positioning a first strip of thermoformable filtering material above at least a rigid body;

joining the first strip of thermoformable filtering material to the rim of the rigid body at an upper surface of the rim that defines a joining zone;

forming the filtering element by plastic deformation to define the chamber adapted to contain the dose of product, the step of forming being achieved by heat transfer;

filling the chamber with a dose of product;

closing the chamber and the upper aperture of the rigid body with a respective closure lid;

wherein said step of joining is achieved by sealing, or hot or cold gluing, or by means of ultrasounds and wherein the step of joining is completed before the step of forming is commenced.

2. Method according to claim 1, wherein the step of feeding provides for feeding the rigid bodies singly.

3. Method according to claim 1, wherein the step of feeding provides for feeding the rigid bodies in form of a second strip of thermoformed alveolate material.

4. Method according to claim 1, including at least one step of cutting at least the first strip and the closure lid, downstream of the step of closing, to achieve single finished capsules.

5. Method according to claim 4, including a further step of cutting of the first strip downstream of the step of joining and upstream of the step of forming, or downstream of the step of forming and upstream of the step of filling.

6. Method according to claim 1, wherein said step of forming includes a first sub-step of forming adapted to partly form the filtering element, and a second sub-step of forming adapted to completely form the filtering element, thus defining the chamber.

7. Method according to claim 6, wherein said first sub-step of forming involves an annular zone of the filtering element, said annular zone being adjacent and internal to the joining zone, and wherein the second sub-step of forming involves a central zone of the filtering element, said central zone being internal to said annular zone.

8. Machine for making single-use capsules for extraction or infusion beverages including a rigid body, cup-shaped and featuring a bottom and an upper aperture with a rim, a filtering element engaging the upper aperture and configured to present a concavity within the rigid body so as to define a chamber adapted to contain a dose of product, and a closure lid adapted to close the chamber and the upper aperture, the machine including:

a feeding system for feeding a first strip of thermoformable filtering material;

a transport system for transporting the rigid bodies along an advancing direction;

a joining station for joining the first strip of thermoformable filtering material to the rigid bodies at a joining zone along the respective rims;

a forming station, arranged downstream of the joining station along the advancing direction, for forming the filtering element that defines the chamber adapted to contain the dose of product;

a filling station for filling the chamber with a respective dose of product;

a closing station for closing the chamber and the upper aperture with a closure lid.

9. Machine according to claim 8, wherein the rigid bodies are fed in form of a second strip of thermoformed alveolate material and the transport system includes pull clamps for pulling said second strip.

10. Machine according to claim 8, wherein said joining station includes one or more joining sealers reciprocatingly movable along a direction perpendicular to the advancing direction.

11. Machine according to claim 8, wherein the forming station includes at least one forming punch.

12. Machine according to claim 11, wherein the forming station includes a first pre-forming punch and a second final forming punch.

13. Machine according to claim 12, wherein said first pre-forming punch is adapted to thermoform an annular zone of the filtering element, said annular zone being adjacent and internal to the joining zone, and wherein said second final forming punch is adapted to thermoform a central zone of the filtering element, said central zone being internal to the annular zone.

14. Machine according to claim 13, wherein said first pre-forming punch includes a ring-shaped element adapted to thermoform the annular zone of the filtering element, said ring-shaped element being reciprocatingly movable along a direction perpendicular to the advancing direction, and wherein said second final-forming punch includes a forming head adapted to thermoform the central zone of the filtering element, said second final forming punch being reciprocatingly movable coaxially to said first pre-forming punch; said second final forming punch being dimensioned to slide within the first pre-forming punch.

15. Machine according to claim 13, wherein said second final forming punch is arranged downstream of said first pre-forming punch along the advancing direction.

16. Machine according to claim 8, including at least one cutting station, integrated into, or arranged downstream of, the closing station.

17. Machine according to claim 8, including at least two cutting stations, a first cutting station arranged immediately downstream of any one of the joining station, forming station and filling station, and a second cutting station integrated into, or arranged downstream of, the closing station.

* * * * *